US005165552A

United States Patent [19]

Muhlbauer

[11] Patent Number: 5,165,552

[45] Date of Patent: Nov. 24, 1992

[54] CYMBAL DISPLAY AND STORAGE RACK

[76] Inventor: Alex Muhlbauer, Theaterstrasse 4 - 5, 3000 Hannover 1, Fed. Rep. of Germany

[21] Appl. No.: 704,416

[22] Filed: May 21, 1991

[51] Int. Cl.[5] ..... A47F 7/00

[52] U.S. Cl. ..... 211/13; 211/41

[58] Field of Search ..... 211/41, 13, 113, 182, 211/59.1

[56] References Cited

U.S. PATENT DOCUMENTS

| | | | |
|---|---|---|---|
| 3,323,657 | 6/1967 | Robbins | 211/182 X |
| 3,335,870 | 8/1967 | Hills | 211/13 |
| 3,341,028 | 9/1967 | Nichols | 211/182 X |
| 3,568,950 | 3/1971 | Niwa | 211/13 X |
| 3,998,332 | 12/1976 | Lambertson | 211/13 |
| 4,666,110 | 5/1987 | Prouty | 211/41 X |
| 4,995,682 | 2/1991 | Gutner | 211/41 X |

*Primary Examiner*—Robert W. Gibson, Jr.
*Attorney, Agent, or Firm*—Neal J. Mosely

[57] ABSTRACT

A cymbal display and storage rack is shown which includes a plurality of overhead supports and a plurality of dividers at the base which provide for storage of cymbals on edge. The rack has a base with supporting feet and elongated upwardly extending supports rebent at the top to provide an overhang extending toward the viewer. A plurality of upwardly extending posts provide support for displaying cymbals. A plurality of posts extending downwardly from the overhang provide overhead support for cymbals at the top of the rack. Support rods having their opposite ends bend 90° in opposite directions are pivotally supported at one end by the upwardly extending supports to support cymbals at their outer, upwardly extending ends and to allow pivotal movement between an inner position for display and an outer position product testing. The pivotal support rods may be supported on the upwardly extending supports or on cross members extending therebetween. At the bottom of the rack, a plurality of upwardly extending divider elements are spaced at selected intervals across the base to provide for storage of cymbals on edge therebetween.

17 Claims, 5 Drawing Sheets

FIGURE 5
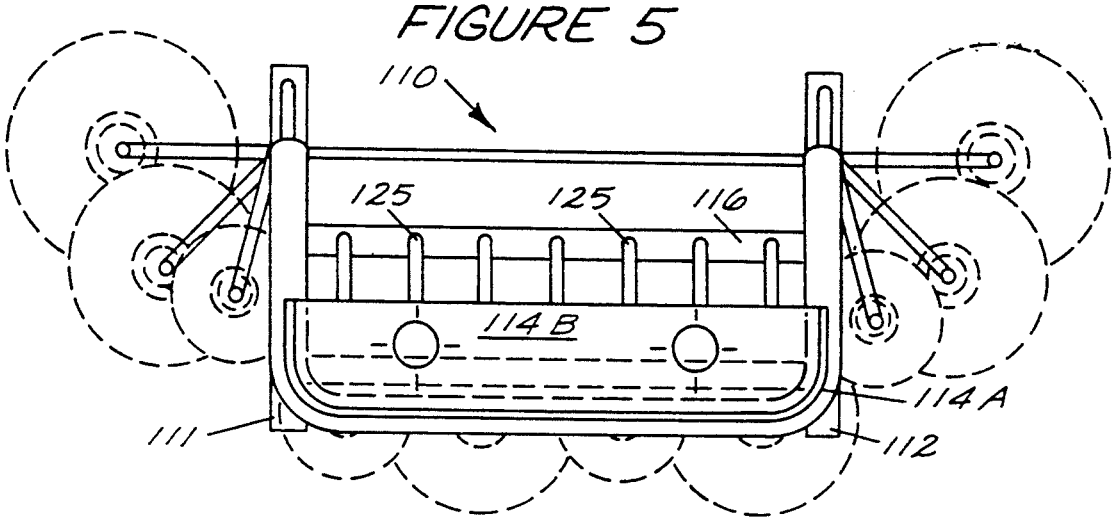
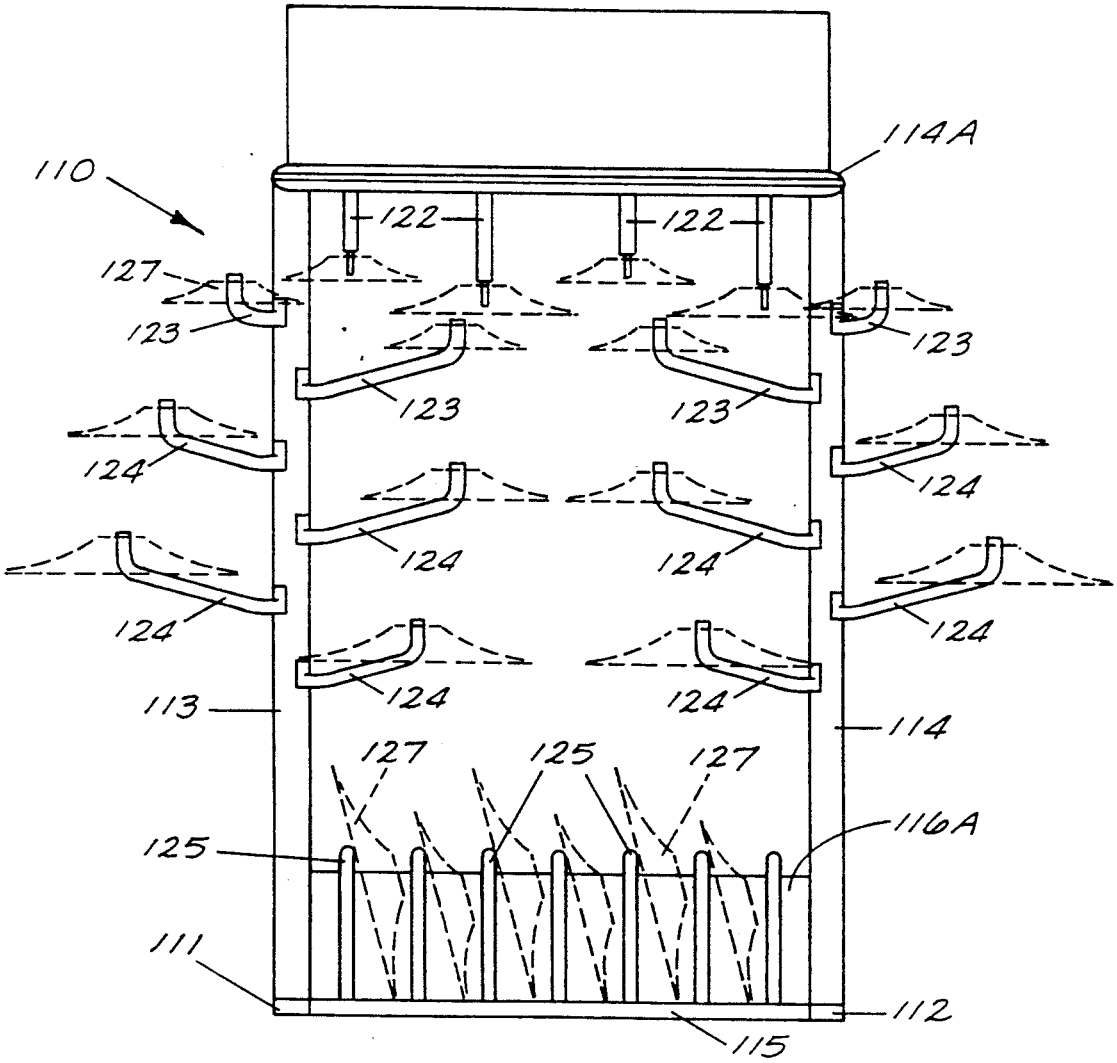
FIGURE 4

CYMBAL DISPLAY AND STORAGE RACK

BACKGROUND OF THE INVENTION

1. Field of the Invention

This invention relates generally to supports for cymbals and more particularly to a combined display and storage rack for cymbals.

2. Brief Description of the Prior Art

Tripod supports are well known for holding cymbals for playing in an orchestra.

Cymbal display supports are also well known for exhibiting cymbals in stores or otherwise in marketing them. An example of a display support, which is currently sold, but for which no literature reference or patent exists, is the Zildjian Cymbal Display Tree which comprises a vertical rack with pivotal arms supporting cymbals at different levels and providing for movement between a playing position and a display position. No storage is provided for the cymbals.

Prouty U.S. Pat. No. 4,666,110 discloses a collapsible holder for cymbals to be stored for use close to the percussionist (cymbal player) in the orchestra. No suggestion is made of any storage apparatus for use in display or exhibition of cymbals in marketing.

The present invention is distinguished over the prior art in general, and this patent in particular, by providing a cymbal display and storage rack which includes a plurality of overhead supports and a plurality of dividers at the base which provide for storage of cymbals on edge. The rack has a base with supporting feet and elongated upwardly extending supports rebent at the top to provide an overhang extending toward the viewer. A plurality of upwardly extending posts provide support for displaying cymbals. A plurality of posts extending downwardly from the overhang provide overhead support for cymbals at the top of the rack. Support rods having their opposite ends bent 90° in opposite directions are pivotally supported at one end by the upwardly extending supports to support cymbals at their outer, upwardly extending ends and to allow pivotal movement between an inner position for display and an outer position product testing. The pivotal support rods may be supported on the upwardly extending supports or on cross members extending therebetween. At the bottom of the rack, a plurality of upwardly extending divider elements are spaced at selected intervals across the base to provide for storage of cymbals on edge therebetween.

SUMMARY OF THE INVENTION

It is therefore an object of the present invention to provide a new and improved support rack for cymbals for exhibition or display.

It is another object of this invention to provide a new and improved support rack for cymbals for exhibition or display which is simple in construction and inexpensive to produce.

Another object of this invention is to provide a new and improved support rack for cymbals for exhibition or display which includes a storage section for storage of cymbals not on display.

Another object of this invention is to provide a new and improved support rack for cymbals for exhibition or display having support arms which allow pivotal movement between an inner position for display and an outer position for product testing and which includes a storage section for storage of cymbals not on display.

Still another object of this invention is to provide a new and improved support rack for cymbals for exhibition or display having a plurality of upwardly extending posts from a base and a plurality of posts extending downwardly from the top to provide fixed supports for cymbals at the top and bottom of the rack and which has support arms which allow pivotal movement between an inner position for display and an outer position for product testing and which includes a storage section for storage of cymbals not on display.

Still another object of this invention is to provide a new and improved support rack for cymbals for exhibition or display having a plurality of upwardly extending posts from a base and a plurality of posts extending downwardly from the top to provide fixed supports for cymbals at the top and bottom of the rack and which has support arms which allow pivotal movement between an inner position for display and an outer position for product testing and which includes a storage section for storage of cymbals on edge while not on display.

Still another object of this invention is to provide a new and improved support rack for cymbals for exhibition or display having a plurality of upwardly extending posts from a base and a plurality of posts extending downwardly from the top to provide fixed supports for cymbals at the top and bottom of the rack and which has support arms having a novel support on the rack which allow pivotal movement between an inner position for display and an outer position for product testing and which includes a storage section for storage of cymbals not on display.

Other objects of the invention will become apparent from time to time throughout the specification and claims as hereinafter related.

The above noted objects and other objects of the invention are accomplished by a cymbal display and storage rack which includes a plurality of overhead supports and a plurality of dividers at the base which provide for storage of cymbals on edge. The rack has a base with supporting feet and elongated upwardly extending supports rebent at the top to provide an overhang extending toward the viewer. A plurality of upwardly extending posts provide support for displaying cymbals. A plurality of posts extending downwardly from the overhang provide overhead support for cymbals at the top of the rack. Support rods having their opposite ends bend 90° in opposite directions are pivotally supported at one end by the upwardly extending supports to support cymbals at their outer, upwardly extending ends and to allow pivotal movement between an inner position for display and an outer position product testing. The pivotal support rods may be supported on the upwardly extending supports or on cross members extending therebetween. At the bottom of the rack, a plurality of upwardly extending divider elements are spaced at selected intervals across the base to provide for storage of cymbals on edge therebetween.

BRIEF DESCRIPTION OF THE DRAWINGS

FIG. 4 is a view in front elevation of the embodiment of the invention shown in FIG. 3.

FIG. 5 is a top plan view of the embodiment of the invention shown in FIG. 3.

DESCRIPTION OF ONE PREFERRED EMBODIMENT

Figure 1:
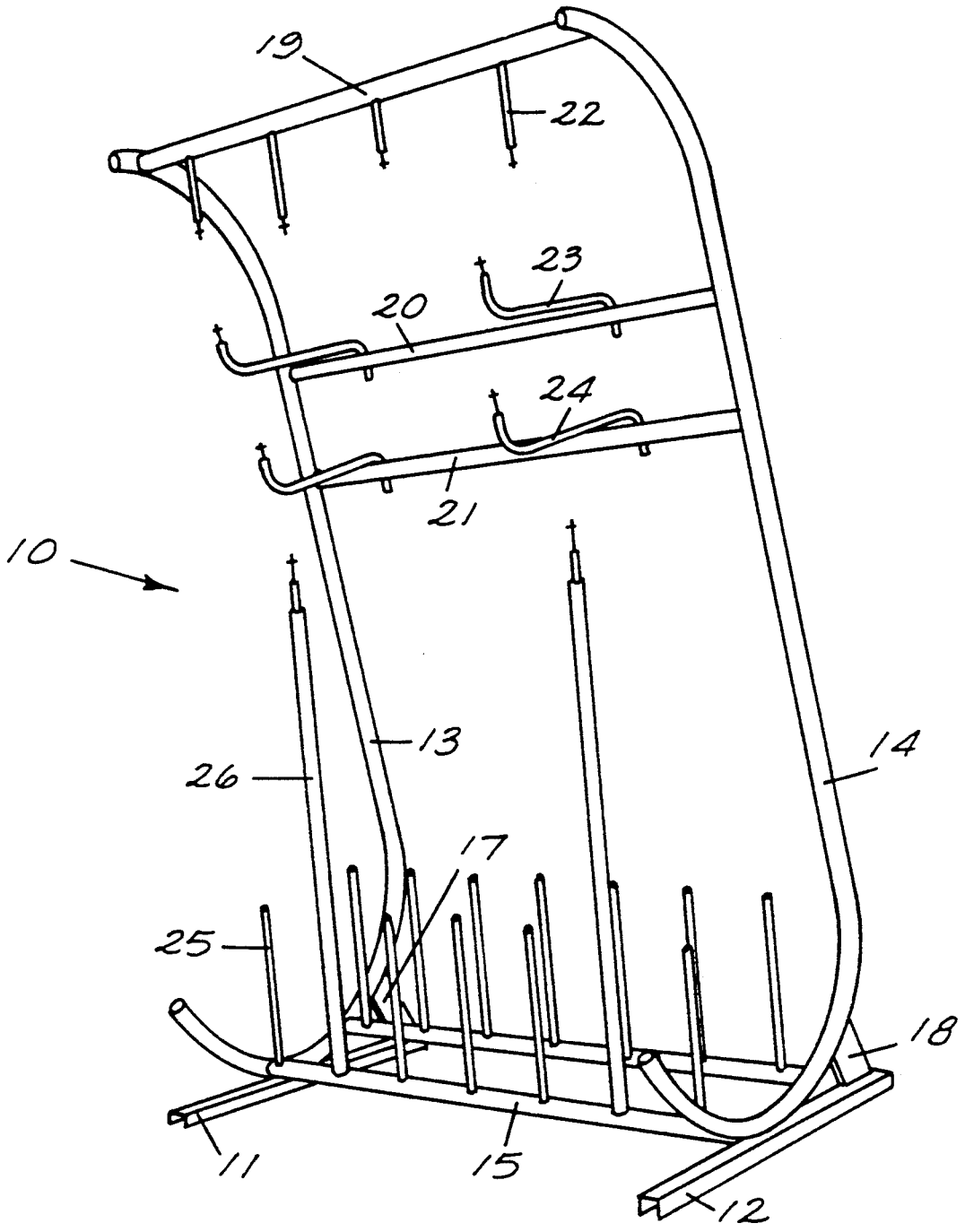
FIG. 1 is an isometric view of a cymbal-supporting rack for exhibiting or displaying cymbals and for storing them when not on display illustrating one embodiment of the present invention.
Figure 2:
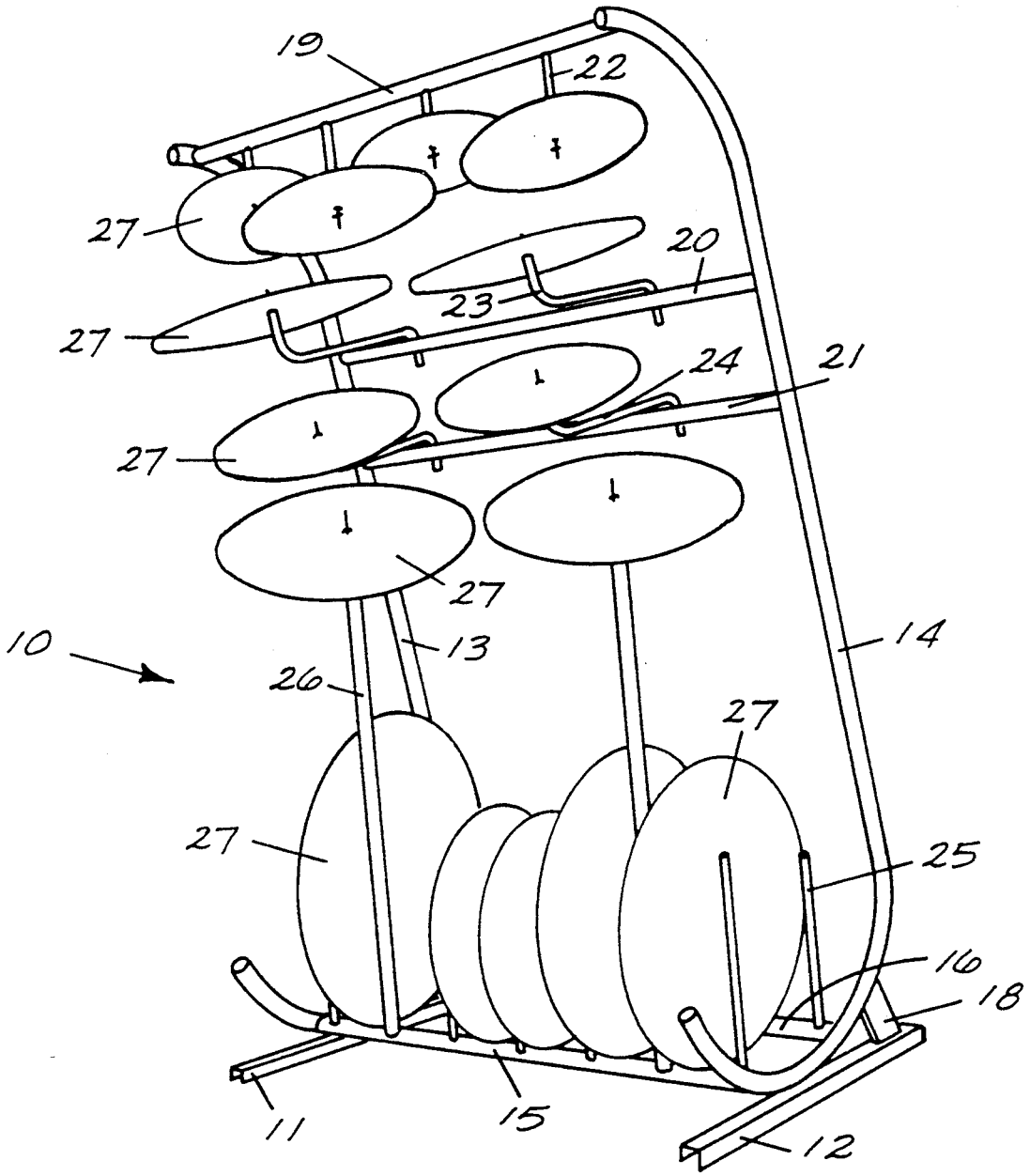
FIG. 2 is an isometric view of a cymbal-supporting rack as shown in FIG. 1 showing cymbals supported for exhibition or display and stored when not on display in accordance with one embodiment of the present invention.

Referring to the drawings by numerals of reference, and more particularly to FIGS. 1 and 2, there is shown one preferred embodiment of a cymbal display and storage rack for display and exhibit of cymbals and for storage of cymbals which are not on display. The structure is of metal and the parts are welded, brazed or soldered together depending on the materials used. It is also possible to construct the rack of extruded plastic, in which case the parts are cemented together.

Cymbal display and storage rack 10 has a base comprising a pair of supporting feet 11 and 12 with elongated upwardly extending supports 13 and 14 rebent at the top to provide an overhang extending toward the viewer. The base is completed by a pair of laterally extending braces 15 and 16 extending between and secured to feet 11 and 12. Braces 17 and 18 provide additional support for the upwardly extending supports 13 and 14. Laterally extending braces 19, 20 and 21 extend between and are secured to the upper end portion of the upwardly extending supports 13 and 14.

A plurality of posts 22 extend downwardly from the brace 19 at the overhang provide overhead support for cymbals at the top of the rack 10. A plurality of support rods 23 have their opposite ends bent 90° in opposite directions and are pivotally supported at one end in brace 20 to support cymbals at their outer, upwardly extending ends and to allow pivotal movement. A plurality of support rods 24 likewise have their opposite ends bent 90° in opposite directions and are pivotally supported at one end in brace 21 to support cymbals at their outer, upwardly extending ends and to allow pivotal movement.

A pair of upwardly extending posts 26 are secured in cross brace 15 and provide support at their upper ends for displaying cymbals. A plurality of upwardly extending divider elements, i.e., rods 25 are spaced at selected intervals across the base and supported on cross braces 15 and 16 to provide for storage of cymbals on edge therebetween.

OPERATION

While the operation of this invention should be obvious from the description of the preferred embodiment, it will be restated herein for clarity.

Rack 10 rests on the floor or other level surface on feet 11 and 12 in an upright position. Rack 10 has an upwardly extending frame comprising the upwardly extending supports 13 and 14, and cross braces 15, 16, 19, 20 and 21. Downwardly extending posts 22 and upwardly extending posts 27 have cymbals 27 supported thereon in a relatively fixed position. Pivotally supported support rods 23 and 24 have cymbals 27 supported thereon and are pivotally movable. At the bottom of the rack cymbals 27 are stored on edge between the upwardly extending rods 25.

ANOTHER EMBODIMENT

Referring to the drawings by numerals of reference, and more particularly to FIGS. 3–6, there is shown another preferred embodiment of a cymbal display and storage rack for display and exhibit of cymbals and for storage of cymbals which are not on display. The structure is of metal and the parts are welded, brazed or soldered together depending on the materials used. It is also possible to construct the rack of extruded plastic, in which case the parts are cemented together.

Figures 3, 3A:
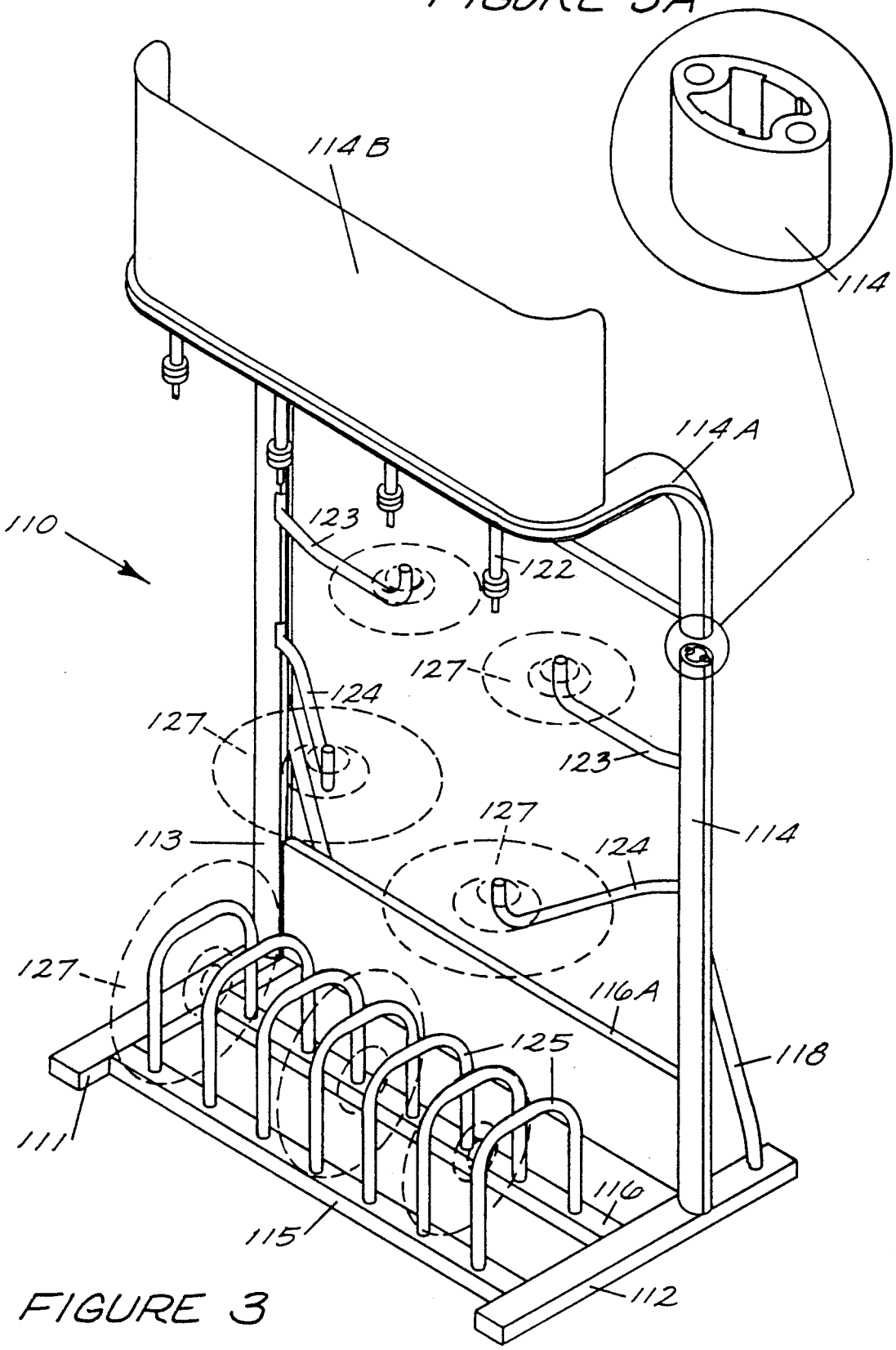
FIG. 3 is an isometric view of a cymbal-supporting rack for exhibiting or displaying cymbals and for storing them when not on display illustrating another embodiment of the present invention.
FIG. 3A is a detail section on one of the vertical supports of the embodiment shown in FIG. 3 showing a novel means of attaching pivoted cymbal supports in the rack of FIG. 3.
Figure 6:
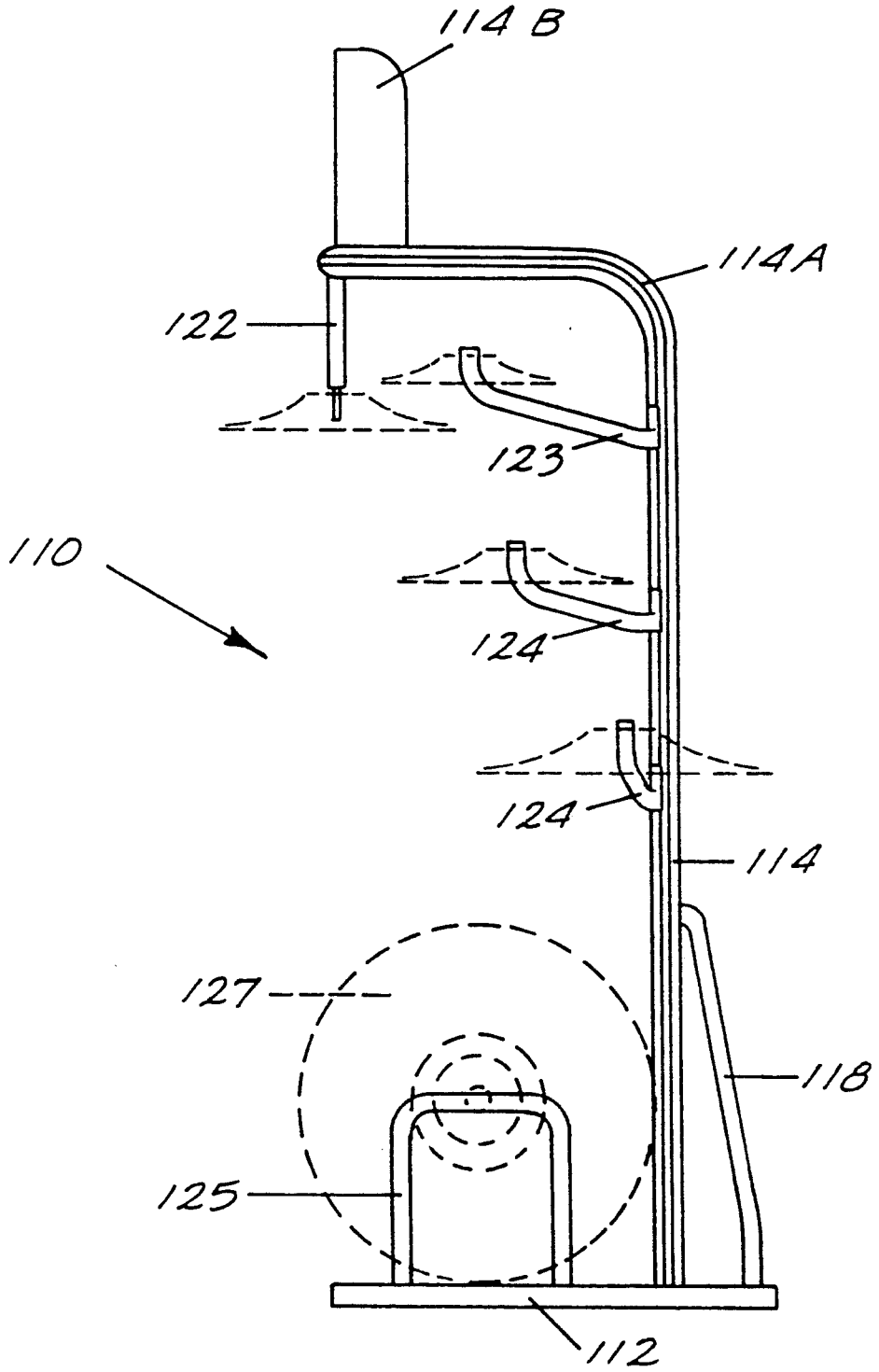
FIG. 6 is a view in right elevation of the embodiment of the invention shown in FIG. 3.

Cymbal display and storage rack 110 has a base comprising a pair of supporting feet 111 and 112 with elongated upwardly extending supports 113 and 114 rebent at the top to provide an overhang 114A extending toward the viewer which supports a display panel 114B on which suitable legends or designs may be placed for decoration or information. The base is completed by a pair of laterally extending braces 115 and 116 extending between and secured to feet 111 and 112. A supporting panel 116A extends between the upwardly extending supports 113 and 114. Braces 117 and 118 provide additional support for the upwardly extending supports 113 and 114. Supports 113 and 114 are of a tubular extrusion as seen in FIG. 3A and have tubular beads 123A for use as described below.

A plurality of posts 122 extend downwardly from the overhang 114A to provide overhead support for cymbals at the top of the rack 110. A plurality of support rods 123 and 124 have their opposite ends bent 90° in opposite directions and are pivotally supported at one end in tubular beads 123A through slots opening thereto through the edge or back of the tubular extrusions forming supports 113 and 114. When support rods 123 and 124 are in place, cymbals may be supported at their outer, upwardly extending ends which allow pivotal movement between an inner position for display and an outer position production testing.

A plurality of upwardly extending divider elements, i.e., rebent or inverted U-shaped rods 125 are spaced at selected intervals across the base and supported on cross braces 115 and 116 to provide for storage of cymbals on edge.

OPERATION

While the operation of this invention should be obvious from the description of the preferred embodiment, it will be restated herein for clarity.

Rack 110 rests on the floor or other level surface ion feet 112 and 112 in an upright position. Rack 110 has an upwardly extending frame comprising the upwardly extending supports 113 and 114, and supporting panel 116A and the cross brace forming overhang 114A. Downwardly extending posts 122 have cymbals 127 supported thereon in a relatively fixed position. Pivotally supported support rods 123 and 124 have cymbals 127 supported thereon and are pivotally movable between an inner position out of use and an outer position to expose the cymbals for testing by a player. At the bottom of the rack cymbals 127 are stored on edge between the upwardly extending inverted U-shaped rods 125.

While this invention has been shown fully and completely with special emphasis on a preferred embodiment, it should be understood that, within the scope of the appended claims, the invention may be practiced otherwise than as specifically described herein.

I claim:

1. A cymbal display and storage rack comprising a base with supporting feet, elongated upwardly extending supports rebent at the top to provide an overhang extending toward the viewer, first cymbal supporting members supported on said overhang and extending downward therefrom for display of cymbals, second cymbal supporting members supported on said base and on said elongated upwardly extending supports for display of cymbals, and third cymbal supporting members supported on said base and spaced thereacross to provide support for edge storage of cymbals thereon.

2. A cymbal display and storage rack according to claim 1 in which said storage and display rack is of metal and the parts are welded, brazed or soldered together.

3. A cymbal display and storage rack according to claim 1 in which said storage and display rack is of plastic and the parts are cemented together.

4. A cymbal display and storage rack according to claim 1 in which said base comprises a pair of supporting feet with a pair of laterally extending braces extending between and secured thereto, said elongated upwardly extending supports have braces extending laterally between and secured to the rebent top portion thereof and between the upwardly extending portion thereof, and said first cymbal supporting members are supported on said braces at said top portion and extend downward therefrom for display of cymbals, said second cymbal supporting members are supported on said braces at said base and on said braces between said elongated upwardly extending supports for display of cymbals, and said third cymbal supporting members are supported on said braces of said base and spaced thereacross to provide support for storage of cymbals thereon.

5. A cymbal display and storage rack according to claim 4 in which said storage and display rack is of metal and the parts are welded, brazed or soldered together.

6. A cymbal display and storage rack according to claim 4 in which said storage and display rack is of plastic and the parts are cemented together.

7. A cymbal display and storage rack according to claim 1 in which said base comprises a pair of supporting feet with a pair of laterally extending braces extending between and secured thereto, said elongated upwardly extending supports have braces extending laterally between and secured to the rebent top portion thereof and between the upwardly extending portion thereof, and said first cymbal supporting members are supported on said braces at said top portion and extend downward therefrom for display of cymbals, said second cymbal supporting members are pivotally supported on said elongated upwardly extending supports for display of cymbals, and said third cymbal supporting members supported on said braces of said base and spaced thereacross to provide support for storage of cymbals thereon.

8. A cymbal display and storage rack according to claim 7 in which said storage and display rack is of metal and the parts are welded, brazed or soldered together.

9. A cymbal display and storage rack according to claim 7 in which said storage and display rack is of plastic and the parts are cemented together.

10. A cymbal display and storage rack according to claim 1 in which said base comprises a pair of supporting feet with a pair of laterally extending braces extending between and secured thereto, said elongated upwardly extending supports have braces extending laterally between and secured to the rebent top portion thereof and between the upwardly extending portion thereof, and said first cymbal supporting members are supported on said braces at said top portion and extend downward therefrom for display of cymbals, said second cymbal supporting members supported on said braces between said elongated upwardly extending supports comprise a plurality of support rods having their opposite ends bent 90° in opposite directions and which are pivotally supported at one end in said braces to support cymbals at their outer, upwardly extending ends and to allow pivotal movement, said second cymbal supporting members supported on said braces in said base comprise upwardly extending posts providing supports at their upper ends for displaying cymbals, and said third cymbal supporting members are supported on said braces of said base and spaced thereacross to provide support for storage of cymbals thereon.

11. A cymbal display and storage rack according to claim 10 in which said storage and display rack is of metal and the parts are welded, brazed or soldered together.

12. A cymbal display and storage rack according to claim 10 in which said storage and display rack is of plastic and the parts are cemented together.

13. A cymbal display and storage rack according to claim 1 in which said base comprises a pair of supporting feet with a pair of laterally extending braces extending between and secured thereto, said elongated upwardly extending supports are of a tubular extrusion and have tubular beads extending longitudinally therein, said first cymbal supporting members are supported on said top portion and extend downward therefrom for display of cymbals, said second cymbal supporting members supported on said elongated upwardly extending supports comprise a plurality of support rods having their opposite ends bent 90° in opposite directions and which are pivotally supported at one end in said tubular beads to support cymbals at their outer, upwardly extending ends and to allow pivotal movement between an inner position for display and an outer position product testing, said third cymbal supporting members are supported on said braces of said base and spaced thereacross to provide support for storage of cymbals thereon.

14. A cymbal display and storage rack according to claim 13 in which said storage and display rack is of metal and the parts are welded, brazed or soldered together.

15. A cymbal display and storage rack according to claim 13 in which said storage and display rack is of plastic and the parts are cemented together.

16. A cymbal display and storage rack according to claim 1 in which said base comprises a pair of supporting feet with a pair of laterally extending braces extending between and secured thereto, said elongated upwardly extending supports are of a tubular extrusion and have tubular beads extending longitudinally therein, said first cymbal supporting members are supported on said top portion and extend downward therefrom for display of cymbals, said second cymbal supporting members supported on said elongated upwardly extending supports comprise a plurality of support rods having their opposite ends bent 90° in opposite directions and which are pivotally supported at one end in said tubular beads to support cymbals at their outer, upwardly extending ends and to allow pivotal movement between an inner position for display and an outer position product testing, said third cymbal supporting members comprise a plurality of upwardly extending divider elements of rebent or inverted U-shaped rods spaced at selected intervals across the base and supported on base braces to provide for storage of cymbals on edge.

17. A cymbal display and storage rack according to claim 16 in which said elongated upwardly extending supports have slots opening into said tubular beads, and said second cymbal support rods having one end inserted through said slots into said tubular beads to support the same for pivotal movement on said elongated upwardly extending supports.

* * * * *